United States Patent [19]

Stamp et al.

[11] Patent Number: 5,003,646

[45] Date of Patent: Apr. 2, 1991

[54] HYDROTHERAPY APPARATUS

[75] Inventors: Roger A. Stamp, Scappose, Oreg.; Farrell D. Williams, Midland, Tex.

[73] Assignee: Hydro Air Industries, Inc., Orange, Calif.

[21] Appl. No.: 38,046

[22] Filed: Apr. 14, 1987 (Under 37 CFR 1.47)

[51] Int. Cl.[5] ..... A61H 33/02

[52] U.S. Cl. ..... 4/542; 4/492; 4/541; 128/66; 239/240; 239/252; 239/428.5

[58] Field of Search ..... 4/541, 542, 544, 543, 4/492, 491; 128/66; 239/428.5, 587, 429, 416.5, 416.4, 416, 413, 252, 240

[56] References Cited

U.S. PATENT DOCUMENTS

| | | | |
|---|---|---|---|
| 1,038,656 | 9/1912 | Reuter | 128/66 |
| 1,101,804 | 6/1914 | Lauter | 128/66 |
| 1,520,554 | 12/1924 | Ankeny et al. | 4/214 |
| 1,948,167 | 2/1934 | Cornwell | 128/66 |
| 1,986,220 | 1/1935 | Russell | 239/229 |
| 2,304,616 | 12/1942 | Watson | 128/66 |
| 2,587,335 | 2/1952 | Landergott | 4/542 |
| 2,591,252 | 4/1952 | Gilson | 4/542 |
| 2,595,491 | 5/1952 | Schweikert | 128/248 |
| 2,661,241 | 12/1953 | Vanaziano | 239/240 X |
| 2,682,868 | 2/1954 | Fortin | 128/66 |
| 2,772,421 | 12/1956 | Friend | 4/544 |
| 3,038,469 | 6/1962 | Jacuzzi | 128/66 |
| 3,067,739 | 12/1962 | Karlik | 128/66 |
| 3,092,101 | 6/1963 | Kinney | 128/66 |
| 3,275,241 | 9/1966 | Saad | 239/252 X |
| 3,286,712 | 11/1966 | Roden | 128/66 |
| 3,287,741 | 11/1966 | Nash | 4/544 |
| 3,297,025 | 1/1967 | Jacuzzi | 128/66 |
| 3,315,692 | 4/1967 | Arneson | 134/167 |
| 3,326,468 | 6/1967 | Bristow et al. | 239/252 X |
| 3,391,411 | 7/1968 | Miller, Jr. | 4/544 |
| 3,396,722 | 8/1968 | Lindberg, Jr. | 128/66 |
| 3,420,226 | 1/1969 | Berry, Sr. | 128/24.1 |
| 3,452,370 | 7/1969 | Jacuzzi | 4/544 |
| 3,474,469 | 10/1969 | Steltz | 4/544 |
| 3,534,730 | 10/1970 | Jacuzzi | 128/66 |
| 3,571,818 | 3/1971 | Jacuzzi | 4/542 |
| 3,587,976 | 6/1971 | Jacuzzi | 239/428.5 |
| 3,616,466 | 11/1971 | Davis | 4/191 |
| 3,693,615 | 9/1972 | Dunoyar | 128/66 |
| 3,736,923 | 6/1973 | Parison | 128/66 |
| 3,753,435 | 8/1973 | Blasnik | 128/66 |
| 3,766,911 | 10/1973 | Green | 128/66 |
| 3,768,462 | 10/1973 | Boulard | 4/606 |
| 3,806,964 | 4/1974 | Vanegas | 4/542 |
| 3,820,172 | 6/1974 | Kane | 4/490 |
| 3,820,173 | 6/1974 | Weller et al. | 4/496 |
| 3,844,278 | 10/1974 | Weider | 128/66 |
| 3,868,945 | 3/1975 | Arnerson | 128/66 |
| 3,868,949 | 3/1975 | Arneson | 128/66 |
| 3,874,374 | 4/1975 | Jacuzzi | 128/66 |
| 3,882,865 | 5/1975 | Hatzitheodorou | 128/232 |
| 3,905,358 | 9/1975 | Jacuzzi | 128/66 |
| 3,910,265 | 10/1975 | Coleman | 128/66 |
| 4,044,953 | 8/1977 | Vogal | 239/229 |
| 4,100,917 | 7/1978 | Talge | 128/66 |
| 4,142,337 | 3/1979 | Holcomb | 52/169.7 |
| 4,166,296 | 9/1979 | Darrah et al. | 4/542 |
| 4,170,044 | 10/1979 | Steimle | 4/542 |
| 4,220,144 | 9/1980 | Balais | 128/62 A |
| 4,220,145 | 9/1980 | Stamp et al. | 128/66 |
| 4,223,668 | 9/1980 | Lamy et al. | 128/66 |
| 4,225,984 | 10/1980 | Lindsey | 4/541 |
| 4,230,276 | 10/1980 | Tinder et al. | 239/229 |

*Primary Examiner*—Henry K. Artis

*Attorney, Agent, or Firm*—Knobbe, Martens, Olson & Bear (List continued on next page.)

[57] ABSTRACT

A hydrotherapy apparatus incorporating a water wheel coupled to a reduction gear assembly for providing a strong jet of water at an extremely uniform rate of rotation, even at slow rotational speeds. The water wheel has a relatively small diameter so that it may be driven at a high rate of speed to minimize any rotational speed variations of the water wheel itself. The water wheel is non-rigidly coupled to the drive shaft of the nozzle by a helical gear which causes the drive shaft to rotate at a slower rate than that of the water wheel.

7 Claims, 3 Drawing Sheets

U.S. PATENT DOCUMENTS
| | | | |
|---|---|---|---|
| 4,233,694 | 11/1980 | Janosko et al. | 4/542 |
| 4,262,371 | 4/1981 | Berry et al. | 4/191 |
| 4,271,543 | 6/1981 | Martin | 4/615 |
| 4,275,713 | 6/1981 | Tellander | 128/66 |
| 4,324,363 | 4/1982 | Rauen | 239/281 A |
| 4,339,833 | 7/1982 | Mandell | 4/542 |
| 4,346,484 | 8/1982 | Martin | 4/507 |
| 4,365,752 | 12/1982 | Waisbren | 239/381 |
| 4,372,494 | 8/1983 | Naturel | 239/553.3 |
| 4,441,488 | 4/1984 | Macabee | 128/66 |
| 4,456,174 | 6/1984 | Neeman | 4/492 |
| 4,502,168 | 3/1985 | Jaworski | 4/496 |
| 4,505,001 | 3/1985 | Fasolino | 15/250 A |
| 4,508,665 | 6/1985 | Spinnett | 261/93 |
| 4,523,340 | 6/1985 | Watkins | 4/542 |
| 4,559,653 | 12/1985 | Mathews | 4/541 |
| 4,563,781 | 1/1986 | James | 4/542 |
| 4,679,258 | 7/1987 | Henkins | 4/542 |
| 4,689,839 | 9/1987 | Henkins | 4/542 |
| 4,692,950 | 9/1987 | Henkins | 4/542 |
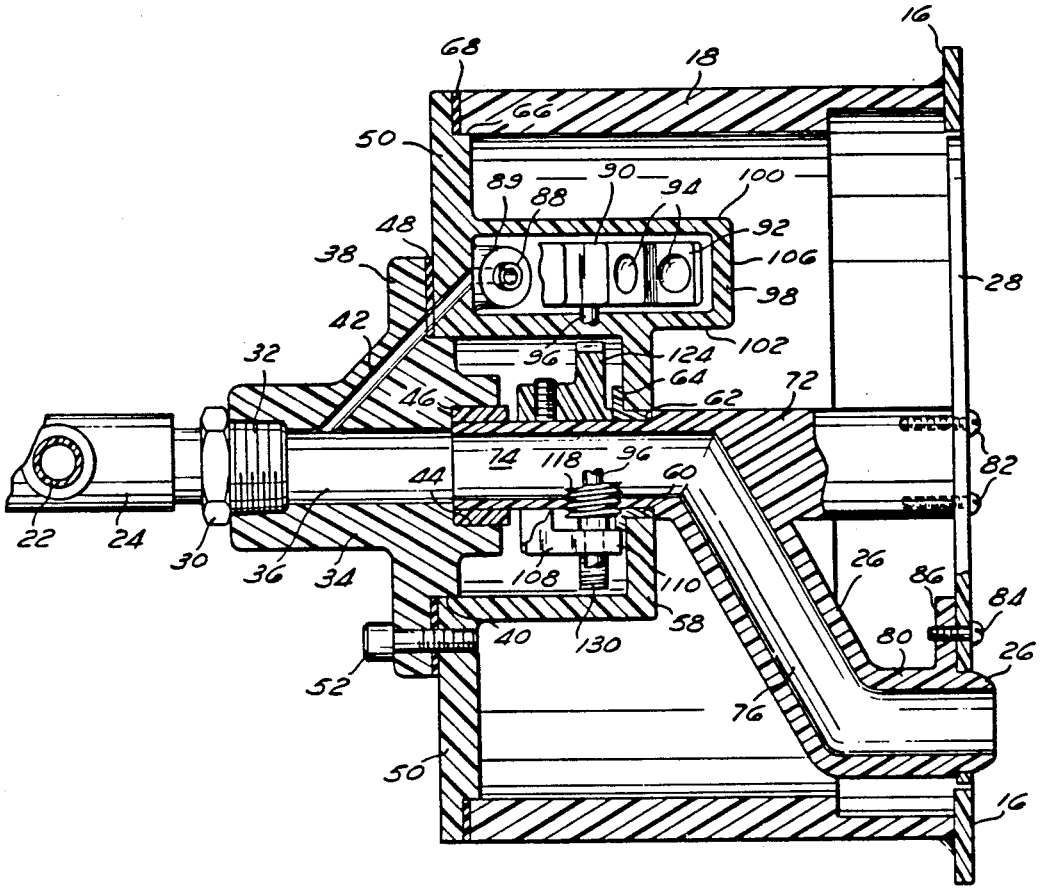

Fig. 1
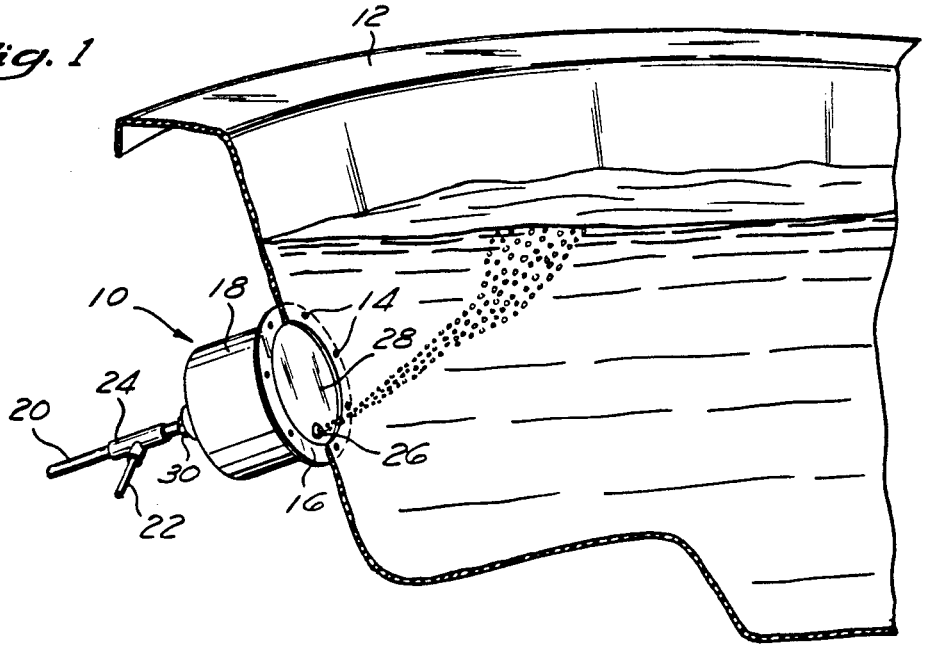
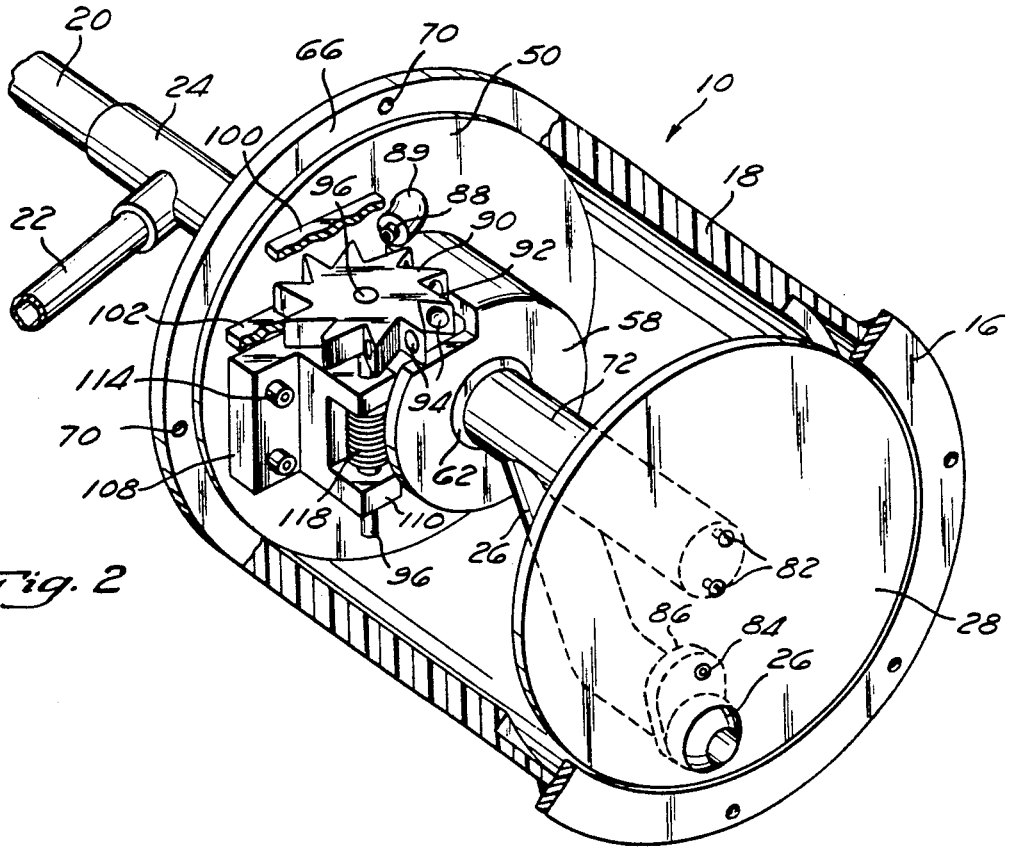
Fig. 2

HYDROTHERAPY APPARATUS

BACKGROUND OF THE INVENTION

This invention relates to a hydrotherapy apparatus used in a tub or spa for generating a slowly rotating jet of water to massage a particular area of the body such as the back. In order to achieve this function, the apparatus is incorporated into the wall of a tub or spa and connected to a source of pressurized water. The pressurized water performs two functions. A first portion of the water is directed by the apparatus to form a jet of water. A second portion of the water is used to drive an internal water motor which, through reduction gears, causes the jet of water to be continuously rotated in a circle. This latter function is advantageous in that it assures predictable, smooth rotation of the jet at a slow speed.

Our prior hydrotherapy device is disclosed in U.S. Pat. No. 4,220,145. The hydrotherapy apparatus disclosed in that patent has a nozzle which continuously rotates through a circular path. The rotating nozzle passes through and is rigidly secured to a water wheel with a plurality of paddles. When the apparatus is connected to a supply of pressurized water, a first portion of the supplied water passes through the nozzle in the center of the water wheel and exits the rotating nozzle at its outlet to form an aerated jet. A second portion of water is tapped from the main supply of pressurized water and, by impinging on the paddles, is used to rotate the water wheel and the nozzle. This water is then supplied to the rotating nozzle.

A hydrotherapy apparatus in accordance with the above-described structure, although advantageous in that it generates a rotating jet of aerated water driven by water pressure, does not maximize the therapeutic benefits which can be obtained. More specifically, the hydrotherapy apparatus does not deliver a strong jet of water at a slow rotational speed without significant variations in rotational speed. Because the nozzle is rigidly fixed to the water wheel, any rotational speed variations of the water wheel will be transmitted to the nozzle without reduction. These rotational speed variations are caused by the friction of the water wheel, which includes random sticking points, and also by the speed surge due to each paddle entering the driving jet of water introduced at the water wheel housing. These rotational speed surges contribute to the rotational instability of the water wheel the most at slow speeds.

The most beneficial therapeutic effects of a rotating jet apparatus are enjoyed when a strong jet of water is supplied at slow rotational speed. The strong jet massages the body and releases muscle tension. Any weakening of the jet reduces this therapeutic effect. If the jet is run at a high speed of rotation, the effective force of the jet felt by a particular area of the body is reduced. Rotational speed surges also deprive particular areas of the full force of the jet.

The above-described hydrotherapy apparatus has a valve which regulates the amount of water flow used to drive the water wheel. If most of the water is used to drive the water wheel, rotational speed nonuniformities will be reduced, but the strength of the jet will be weakened, thus compromising therapeutic benefits. If only a small amount of water is used to drive the water wheel, speed nonuniformities will increase. Thus, the benefit of a strong jet must be compromised to obtain the benefit of uniform rotation.

SUMMARY OF THE INVENTION

These and other disadvantages of previous hydrotherapy apparatuses are overcome by a hydrotherapy apparatus incorporating a water wheel coupled to a reduction gear assembly for providing a strong jet of water at an extremely uniform rate of rotation, even at slow rotational speeds. To this end, the water wheel has a relatively small diameter so that it may be driven at a high rate of speed to minimize any rotational speed variations of the water wheel itself. In addition, the water wheel is non-rigidly coupled to the drive shaft of the nozzle by a helical gear which causes the drive shaft to rotate at a slower rate than that of the water wheel. Because the rate of rotation of the water wheel is greater than that of the nozzle, any rotational nonuniformities of the water wheel which occur despite its small diameter are further reduced upon transmission to the rotating nozzle. Thus, the therapeutic benefits of a strong jet of water delivered at a relatively constant slow speed are achieved.

Still another feature of the invention lies in the connection of the nozzle to a relatively thin rotating circular plate instead of a flywheel. The circular plate has relatively low mass and inertia. Because the circular plate is relatively thin, the surface area of the plate adjacent the interior surfaces of the apparatus housing is minimized so that the frictional effect of any contact between the rotating plate and the stationary housing is significantly reduced.

Still another feature of the invention includes mounting the water wheel in the interior of the mounting enclosure adjacent the nozzle to provide a very compact hydrotherapy apparatus. Since the water wheel lies in the interior of the mounting enclosure which is in fluid communication with the water in the tub or spa, no separate water wheel exhaust line is necessary to channel the water exhausted from the water wheel housing to the tub or spa.

These and other objects, features, and advantages of the present invention will be apparent to those of ordinary skill in the art in view of the detailed description of a preferred embodiment, which is made with reference to the drawings described below.

BRIEF DESCRIPTION OF THE DRAWINGS

FIG. 1 is a cross-sectional view of a tub to which is attached a hydrotherapy apparatus in accordance with a preferred embodiment of the present invention;

FIG. 2 is a perspective view of the internal construction of the hydrotherapy apparatus of FIG. 1, with portions removed for clarity;

DETAILED DESCRIPTION OF A PREFERRED EMBODIMENT

Figure 3:
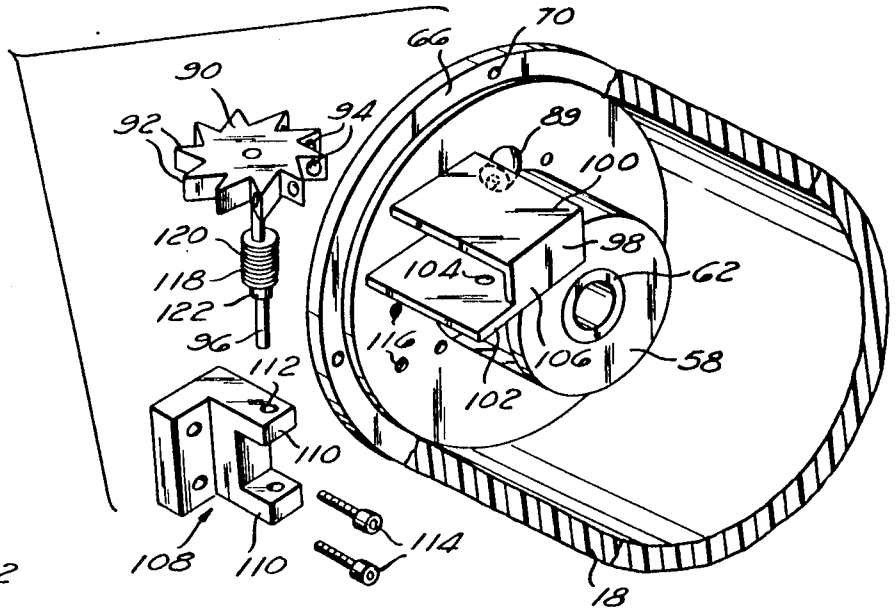
FIG. 3 is an exploded view of a portion of the interior of the hydrotherapy apparatus.
Figure 4:
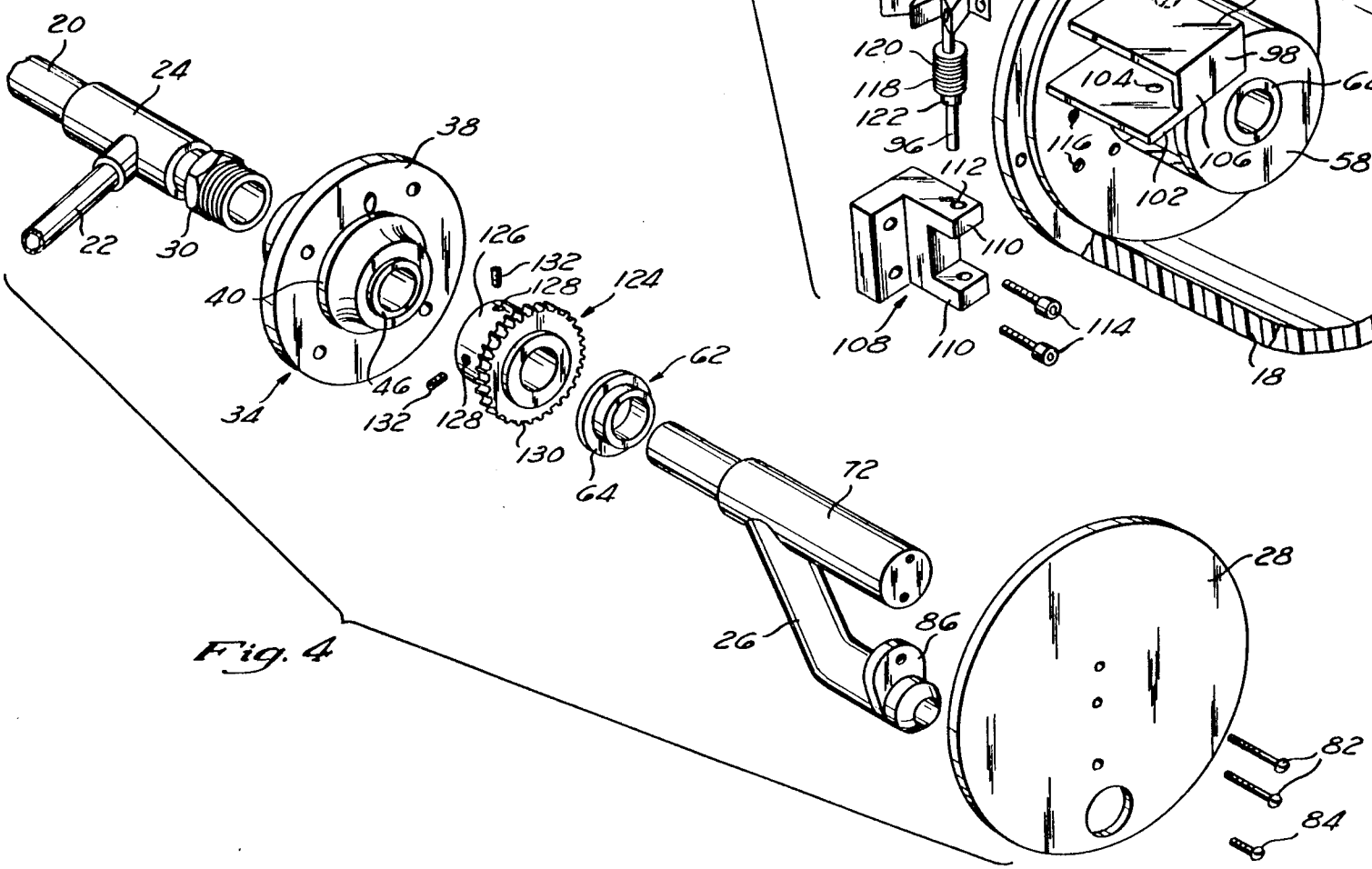
FIG. 4 is an exploded view of the remainder of the hydrotherapy apparatus not shown in FIG. 3.

Referring to FIG. 1, a preferred embodiment of the invention is a hydrotherapy apparatus 10 shown attached to a tub 12. The apparatus 10 is fixed to the tub 12 by a plurality of nut and bolt assemblies 14 located about the circumference of a flat circular ring 16 cemented to a cylindrical housing 18. A water supply line 20 and an air supply line 22 are connected to the apparatus 10 through a venturi valve 24. When the water supply line 20 is connected to a source of pressurized water, the flow of water from the water supply line 20 through the venturi valve 24 causes air to be drawn in through the air supply line 22 to provide an aerated jet of water which is emitted from the apparatus 10 at a nozzle 26. The nozzle 26 is fixably attached to a circular plate 28 whose exterior surface is flush with the interior wall of the tub 12. The nozzle 26 and the circular plate 28 are rotated by a portion of the pressurized water introduced to the apparatus 10 so that a rotating jet of aerated water is produced within the tub 12 in order to massage a particular area of the body such as the back.

Figure 5:
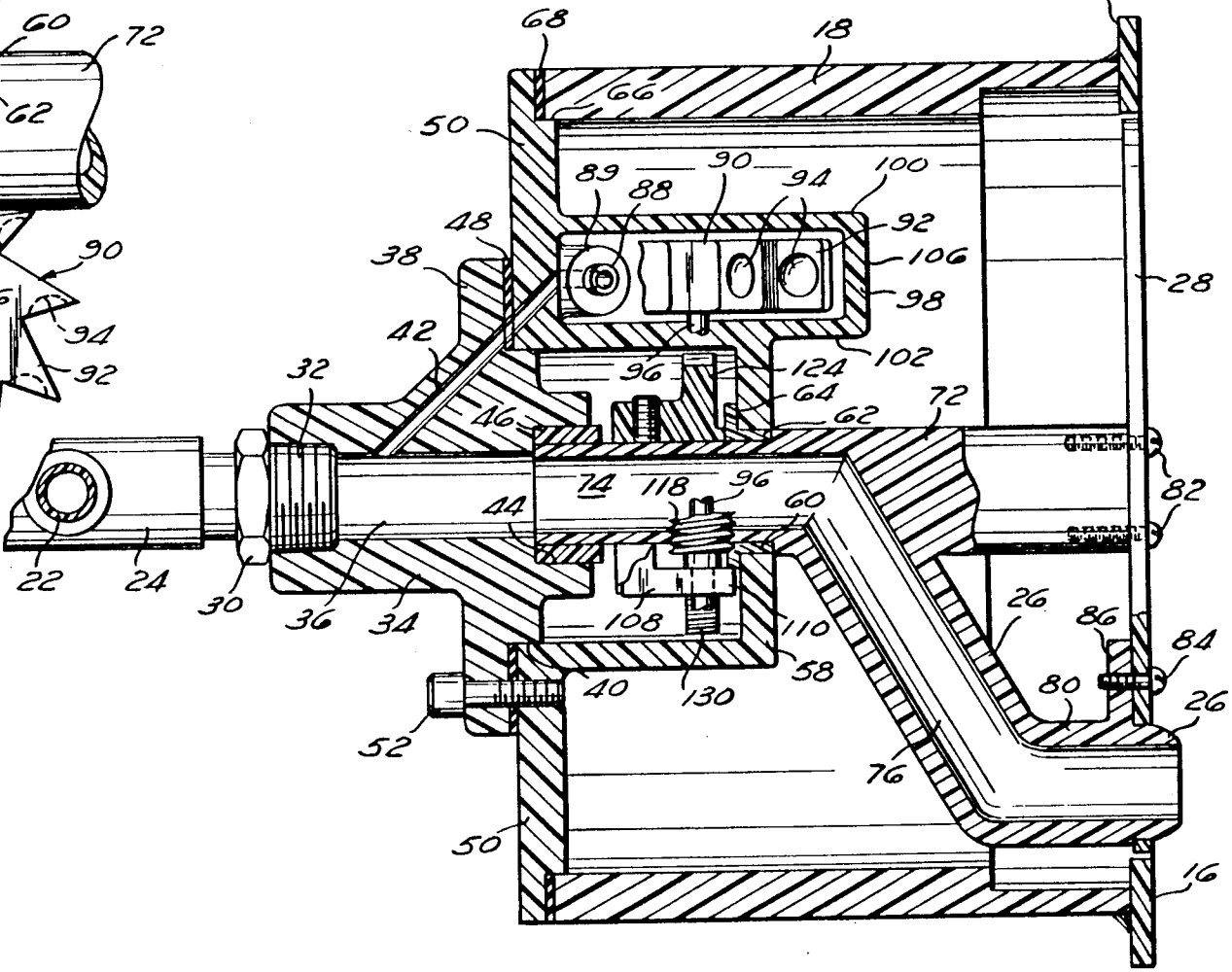
FIG. 5 is a cross-sectional view of the hydrotherapy apparatus with portions removed for clarity.

Referring now to FIG. 5, attached to the venturi valve 24 is a nut 30 which is coupled to a supply port comprising a threaded bore 32 formed in a base 34, thereby fluidly coupling the venturi valve 24 to a lengthwise conduit 36 formed within the base 34. The base 34 is generally cylindrical in shape, but has an annular chassis seat 38 and an annular chassis guide 40 both of larger diameters than that of the base 34. A second conduit 42 which is smaller in diameter than the conduit 36 is angularly formed in the base 34. This conduit 42 is fluidly coupled to and intersects the conduit 36 at an angle of approximately 45°. The end of the base 34 opposite the threaded bore 32 has an annular recess 44 to accommodate a washer 46. The washer 46, which is of compressible plastic and has an outer diameter substantially equal to the inner diameter of the recess 44, is held in place by the friction produced against the recess 44 by the slight compression of the washer 46.

A rubber gasket 48 is interposed between the seat 38 of the base 34 and a circular chassis 50. The base 34 is fixably attached to the chassis 50 by four threaded bolts 52.

A gear housing 58 is integrally formed with the chassis 50. The gear housing 58 is generally cylindrical with an inside diameter substantially the same as the outside diameter of the chassis guide 40. The top of the gear housing 58 has a circular opening 60 of a diameter just large enough to accommodate a slightly compressible plastic washer 62 with a collar 64 which abuts the underside of the gear housing 58. The compression of the washer 62 holds it in place within the circular opening 60.

The chassis 50 has an annular lip 66 about its circumference. In order to form a water-tight seal, this lip 66 is adapted to receive a circular rubber washer 68 and the cylindrical housing 18, which is anchored to the chassis 50 by a plurality of bolts (not shown) threaded into the housing 18 through a number of holes 70 in the lip 66. The end of the housing 18 opposite the washer 68 is cemented to the flat circular ring 16 which is attached to the side of the tub 12.

The washer 62 in the gear housing 58 and the washer 46 in the base 34 support a drive shaft 72 and define its rotation within the apparatus 10. The drive shaft 72, which is cylindrical in shape, has a conduit 74 formed within a portion of its length. One end of the conduit 74 is fluidly coupled to the lengthwise conduit 36 formed in the base 34 while its other end is fluidly coupled to a conduit 76 formed in the nozzle 26 integrally formed with the drive shaft 72. The nozzle 26 has an elbow 80 which alters the direction of the conduit 76. Between the elbow 80 and the drive shaft 72, the conduit 76 lies at an angle with respect to the drive shaft 72, while the remaining portion of the conduit 76 past the elbow 80 lies parallel to the drive shaft 72. This parallel portion of the conduit 76 must be of a minimum length to ensure that the jet of water formed by the apparatus 10 is expelled in a direction perpendicular to circular plate 28 so that the greatest amount of pressure is exerted on the portion of the body being massaged by the apparatus 10.

Both the drive shaft 72 and the nozzle 26 are attached to the circular plate 28 by three screws 82, 84. Two of these screws 82 are threaded directly through the circular plate 28 into the drive shaft 72, while the third screw 84 is threaded through the plate 28 into an elliptical extension 86 of the drive shaft 72. In the embodiment described herein, the nozzle 26 is attached to the circular plate 28 at a point approximately 3½ inches from the center of the plate 28. Thus, the circle defined by the rotation of the nozzle 26 is approximately seven inches in diameter. The diameter of the circular plate 28, which is approximately eight inches in this embodiment, is slightly smaller than the inside diameter of the circular ring 16 to allow for rotation of the plate 28. As a result of this difference in diameters, when attached to the tub 12 below the waterline, the apparatus interior is filled with water during normal operation. The presence of water inside the housing 18 does not present a significant problem as a result of its fluid friction exerted against the rotating nozzle 26 since the speed of rotation is relatively slow.

A portion of the pressurized water introduced at the supply port is used to rotate the drive shaft 72 and the nozzle 26. To this end, the conduit 42 angularly formed in the base 34 is connected to a drive nozzle 88, which is connected to an elbow 89 integrally formed in the chassis 50. Referring now to FIG. 2, the drive nozzle 88 is directed at a water wheel 90 having a plurality of teeth 92 (e.g., ten teeth) about its circumference. Each of the teeth 92 has a circular concave depression 94 formed therein in order to increase the effective force exerted by the water as it impacts the water wheel 90. The relatively small diameter of the water wheel 90, approximately three inches, allows it to be driven at a high rate of speed so that rotational speed variations of the water wheel 90 itself are minimized. The water wheel 90 is rotatably supported in place by an axle 96 which extends through its center.

As shown in FIG. 5, the water wheel 90 is partially enclosed by a water wheel housing 98 on the chassis 50. The water wheel housing 98, which is generally in the shape of a box having one edge surface removed to form an open end, has a first generally square side face 100 and a somewhat larger opposing side face 102 having a circular aperture 104 (shown in FIG. 3) at its approximate center to accommodate the passage of the axle 96 therethrough. The two side faces 100 and 102 are joined by a rectangular face (not shown) perpendicular to the chassis 50 through which the water wheel drive nozzle 88 passes and a rectangular top face 106 parallel to the chassis 50.

Referring now to FIG. 3, the water wheel 90 is situated in the interior of the apparatus 10 enclosed by the housing 18. As a result, the open end of the water wheel housing 98 is in fluid communication with the interior of the apparatus 10 so that no separate water line is required to channel the water exiting the drive nozzle 88 to the interior of the apparatus 10.

The axle 96 which supports the water wheel 90 is itself supported by a plastic mounting bracket 108 with two upright extending arms 110. Each of these arms 110 has a circular aperture 112 therein through which the axle 96 passes. The apertures 112 are of a slightly larger diameter so as to allow the axle 96 to freely rotate within the mounting bracket 108. The mounting bracket 108 is fixed to the chassis 50 by a pair of bolts 114 which extend through the mounting bracket 108 into a pair of threaded holes 116 in the chassis 50.

Attached to the axle 96 between the two arms 110 of the mounting bracket 108 is a helical gear 118. The inside diameter of the helical gear 118 allows the axle 96 to be translated therethrough only under significant force so as to effect a friction fit between the axle 96 and the gear 118. The helical gear 118 has a threaded portion 120 and a flat portion 122. The total length of the gear 118 is slightly smaller than the space between the two arms 110 of the mounting bracket 108.

Figure 6:
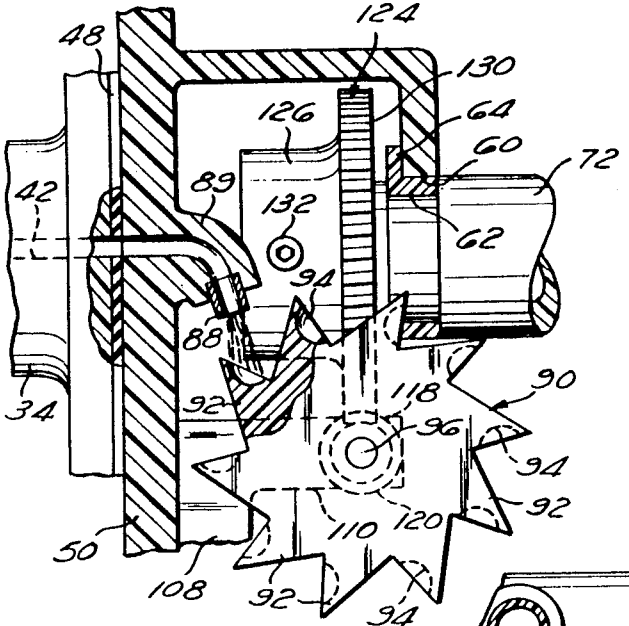
FIG. 6 is a cross-sectional view of a portion of the reduction gear assembly of the hydrotherapy apparatus.

Referring now to FIG. 6, the helical gear 118 is mechanically coupled to a generally cylindrical drive gear 124 attached to the drive shaft 72. The drive gear 124 consists of a smooth portion 126 having a pair of threaded holes 128 therein and a larger-diameter toothed portion 130. A pair of screws 132 are threadable into the holes 128 so that the screw ends firmly make contact with the surface of the drive shaft 72 so that the drive gear 124 and the shaft 72 rotate together. The toothed portion 130 of the drive gear 124 contacts the threaded portion 120 of the helical gear 118 so that the rotation of the gear 118 causes the drive gear 124, and in turn, the drive shaft 72 and the nozzle 26 to rotate.

The helical gear 118 and the cylindrical drive gear 124 together form a reduction gear assembly which causes the drive shaft 72 to be rotated at a slower angular rate than that of the water wheel 90. This reduction gear assembly minimizes the transmission to the nozzle of any speed variations of the water wheel 90 that occur despite its relatively small diameter. In this embodiment of the invention, the water wheel 90 completes approximately 60 revolutions for each revolution of the drive shaft 72. Although the toothed portion 130 of the drive gear 124 is illustrated as having only approximately 30 teeth for purposes of simplicity, the gear 124 of this embodiment actually has approximately 60 teeth. Of course, many different gearing ratios could be used.

Modifications and alternative embodiments of the invention will be apparent to those skilled in the art in view of the foregoing description. This description is to be construed as illustrative only, and is for the purpose of teaching those skilled in the art the best mode of carrying out the invention. The details of the embodiment described may be varied substantially without departing from the spirit of the invention, and the exclusive use of all modifications which come within the scope of the following claims is reserved.

What is claimed is:

1. A hydrotherapy apparatus for producing a rotating jet of water, comprising:

a supply port;

a water wheel housing having an inlet port;

a water wheel within said housing, said water wheel having a plurality of teeth about its circumference, said teeth having a plurality of circular concave depressions formed therein;

an axle extending into said housing through an aperture in said housing, said axle extending into the center of said water wheel thereby rotatably supporting said water wheel;

means for rotatably supporting said axle;

a first conduit fluidly connecting said supply port to said inlet port for supplying pressurized water from said supply port to said inlet port to rotatably drive said water wheel;

a helical gear attached to said axle whereby said helical gear rotates at the same angular rate as that of said water wheel;

a circular gear mechanically coupled to said helical gear whereby said helical gear drives aid circular gear at a lower angular rate than that of said helical gear, said circular gear being attached to a drive shaft;

a second conduit fluidly connected to said supply port, said second conduit extending through a portion of said drive shaft;

a nozzle connected to said drive shaft, said nozzle having a third conduit formed therein in fluid communication with said second conduit for producing a jet of water, said nozzle having a first portion extending radially outward from said drive shaft and a second portion extending in a direction parallel to said drive shaft;

a fastener for rigidly fastening said circular gear to said drive shaft whereby said circular gear is not rotatable with respect to said drive shaft; and a rotatable plate fixably attached to said drive shaft, said plate having an opening displaced from its center through which said nozzle passes, said drive shaft rotatably driving said plate and said nozzle to cause the jet of water produced by said nozzle to continuously rotate through a circle.

2. A hydrotherapy apparatus for producing a rotating jet of water, comprising:

a supply port;

a water wheel fluidly coupled to said supply port whereby water introduced at said supply port rotatably drives said water wheel;

a nozzle connected to a circular plate at a point displaced from the center of said plate for producing a jet of water in a direction substantially perpendicular to said circular plate;

an elongate drive shaft supporting said circular plate;

a coupler for coupling said water wheel to said drive shaft whereby rotation of said water wheel induces rotation of said nozzle at an extremely uniform angular rate, said angular rate being smaller than that of said water wheel;

a tub; and a cylindrical housing, one end of which is secured to an interior wall of said tub, said circular plate substantially covering said end of said cylindrical housing yet permitting fluid flow from said water wheel around said plate and into said tub, wherein said drive shaft is in fluid communication with the interior cylindrical wall of said cylindrical housing.

3. A hydrotherapy apparatus as claimed in claim 1 wherein said coupler comprises:

an axle extending through the center of said water wheel;

means for supporting said axle;

a helical gear attached to said axle having a diameter substantially smaller than the diameter of said water wheel whereby said helical gear rotates with the same angular rate as that of said water wheel; and a circular gear attached to said drive shaft for cooperating with said helical gear to rotate said drive shaft at a slower angular rate than that of said helical gear and said water wheel.

4. A hydrotherapy apparatus as claimed in claim 2, additionally comprising a water wheel housing within said cylindrical housing partially enclosing said water wheel but permitting fluid communication between said interior of said cylindrical housing and said interior of said water wheel housing.

5. A hydrotherapy apparatus as claimed in claim 4 wherein said water wheel has a plurality of teeth about its circumference, said teeth having a plurality of circular concave depressions formed therein.

6. A hydrotherapy apparatus as claimed in claim 5 wherein a portion of said drive shaft has a conduit formed therein, said conduit being fluidly coupled to said supply port and said nozzle.

7. A hydrotherapy apparatus as claimed in claim 6 wherein a portion of the water introduced at said supply port is diverted from said nozzle to drive said water wheel.

* * * * *